United States Patent [19]

Rosenberg et al.

[11] 4,193,141

[45] Mar. 18, 1980

[54] REST ROOM, ESPECIALLY FOR DISABLED PERSONS

[75] Inventors: Ralf H. S. Rosenberg; Morgan H. O. Ferm, both of Göteborg, Sweden

[73] Assignee: Ifo Sanitar AB, Bromolla, Sweden

[21] Appl. No.: 945,712

[22] Filed: Sep. 25, 1978

[30] Foreign Application Priority Data

Sep. 28, 1977 [SE] Sweden ..... 7710825

[51] Int. Cl.[2] ..... A47K 17/00; A47K 3/22; A47K 11/08

[52] U.S. Cl. ..... 4/1; 4/6; 4/7; 4/145; 4/146

[58] Field of Search ..... 4/1–3, 4/6–5, 7, DIG. 2, 145, 146

[56] References Cited

U.S. PATENT DOCUMENTS

| | | | |
|---|---|---|---|
| 2,826,762 | 3/1958 | Colonna | 4/DIG. 2 |
| 3,528,112 | 9/1970 | Warnick | 4/6 X |
| 3,789,436 | 2/1974 | Maier-Gerber | 4/DIG. 2 |
| 3,829,906 | 8/1974 | McPhee | 4/DIG. 2 |
| 3,869,732 | 3/1975 | Garvey et al. | 4/1 |
| 4,094,019 | 6/1978 | Moore et al. | 4/DIG. 2 |
| 4,123,808 | 11/1978 | Guarrera | 4/6 |

FOREIGN PATENT DOCUMENTS

| | | | |
|---|---|---|---|
| 2410888 | 9/1974 | Fed. Rep. of Germany | 4/DIG. 2 |

*Primary Examiner*—Henry K. Artis

*Attorney, Agent, or Firm*—Sughrue, Rothwell, Mion, Zinn and Macpeak

[57] ABSTRACT

The invention concerns a restroom for disabled persons. The problem solved by the invention is the difficulty which such persons experience when trying to use the various facilities of a conventional restroom. A restroom according to the invention includes a swingable wall carrying a bidet seat which is swingable around a horizontal axis and may perform two further functions. One of them is to allow the disabled person, while sitting on the seat, to move to and from a sanitary apparatus, such as a wash basin. The second function is to serve as a support when swung upwards to a vertical position.

4 Claims, 10 Drawing Figures

12
13
14
16
23
33
20
27
26
29
15
12
30
28
21
22
28
24
31
34
35

REST ROOM, ESPECIALLY FOR DISABLED PERSONS

BACKGROUND OF THE INVENTION

The present invention relates to a restroom, adapted to be used by disabled persons and comprising a wall carrying a seat foldable between an upper, vertical and a lower, horizontal position. In the last-mentioned position the seat forms the support surface of a bidet. The bidet function is performed by the introduction of a hand shower nozzle below a central opening in the seat.

When a disabled person is to visit a restroom he is confronted with two major problems. One of those problems is to enter the room, e.g. in a wheel-chair, to rise from the wheel-chair, to find a place in which he can safely remain standing, to sit down on a toilet or a bidet and then to revert to the wheel-chair. Another problem is to wash the body, especially its private parts. In this connection it should be remembered that, like very old people, disabled individuals often suffer from various diseases which significantly increase the need of frequently carrying out such washing operations. However, for corresponding reasons, the mobility of those persons is often very reduced, meaning that they also experience difficulties in reaching the abdomen.

A consideration of the above-mentioned problems must include the following two factors. The first one is that many disabled persons are forced to stay in hospitals just because, with the aid of the equipment available in their homes, they cannot themselves take care of their personal hygiene. The second aspect is that of privacy. Even if other individuals are at disposal, at home or in a hospital, to give the necessary assistance, most persons have a natural desire to be able themselves to perform such washing operations. The corresponding feeling is even especially prominent with disabled persons who are forced in so many other areas to receive assistance and mentally to accept their inability to perform several tasks.

SUMMARY OF THE INVENTION

The object of the invention is to provide a restroom arranged and equipped in such a way that it adequately solves the problems above discussed. As mentioned above, the restroom is of the type having on one of its walls a seat which may be swung between an upper vertical and a lower horizontal position, in which latter position it does together with a hand shower form a bidet. According to the main characteristic of the invention the seat carries a member which, in the upper position of the seat, projects into the room and has a support surface for a semi-sitting person. The wall is around a vertical axis swingable between a first position permitting a disabled person conveniently to sit down on or to rise from the seat, and a second position, in which the seat is located opposite a sanitary apparatus, such as a wash basin. Alternatively, the seat may in said second position of the wall together with a second swingable wall and two fixed walls, each carrying one of said swingable walls, define an omnilaterally closed shower cabin.

THE STANDING OF THE ART

It is per se known to provide a restroom with swingable walls. U.S. Pat. No. 3,869,732 to Garvey et al discloses such a restroom. However, it is not more useful to disabled persons than a conventional restroom. The swinging walls are not relied upon to facilitate the use of the installations. Instead, they normally occupy fixed positions and are swung only when to be cleaned.

U.S. Pat. No. 3,719,959 to Ekstrom discloses a restroom having a swingable wall carrying a wash basin. Again, the design does not satisfy the special needs of disabled persons and does not claim to do so. The object is to save floor area.

Finally, while there are available on the market bidets consisting of a foldable seat and a hand shower, such seats cannot serve as supports for disabled persons.

PRESENTATION OF THE DRAWINGS

Two embodiments of the invention will now be described with reference to the drawing.

Figure 2:
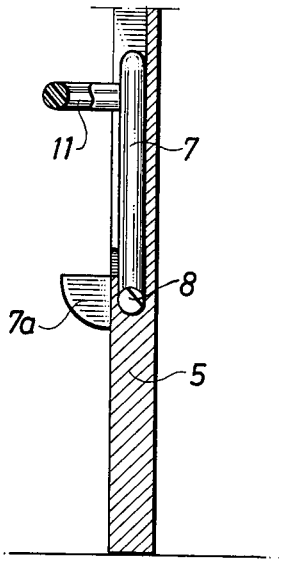
FIG. 2 shows, on a larger scale, a vertical section through the wall and the seat.
Figure 3:
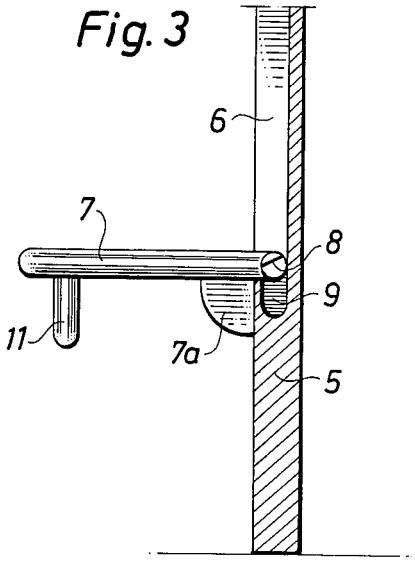

FIG. 3 corresponds to FIG. 2 but shows the seat in its horizontal position.

Figure 4A:
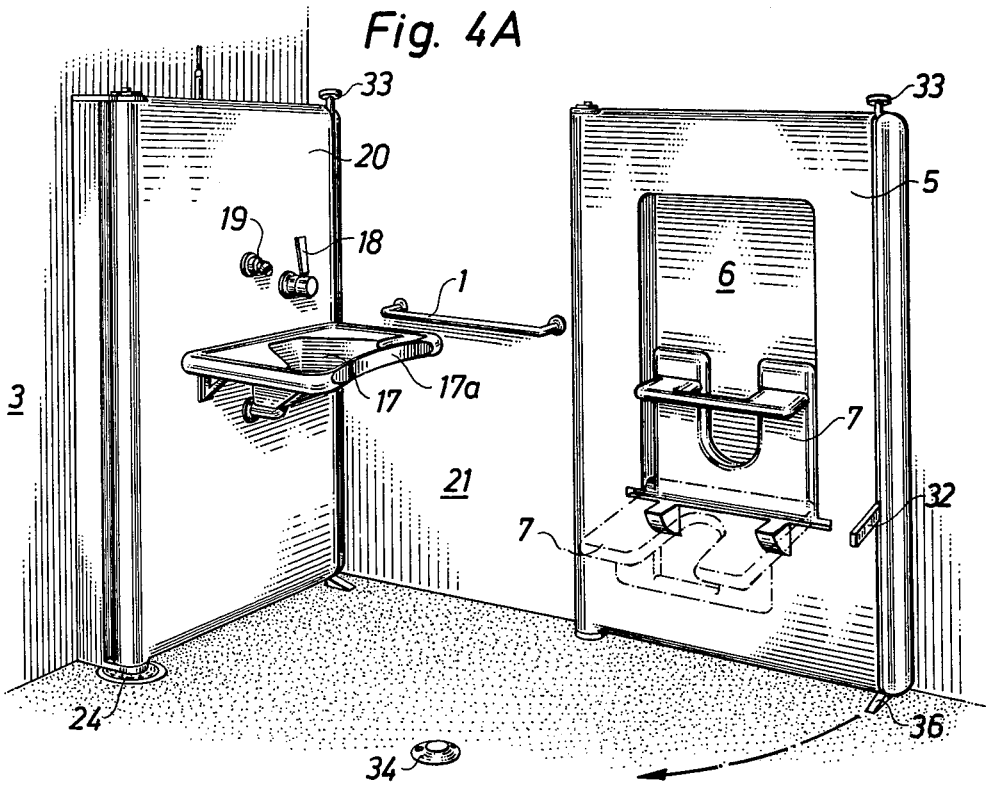

FIG. 4A is a perspective view illustrating the second embodiment. In this case the room has two swingable walls one of which carries the seat and the other one a wash basin. Both walls are in FIG. 4A shown in their open end positions.

Figure 4B:
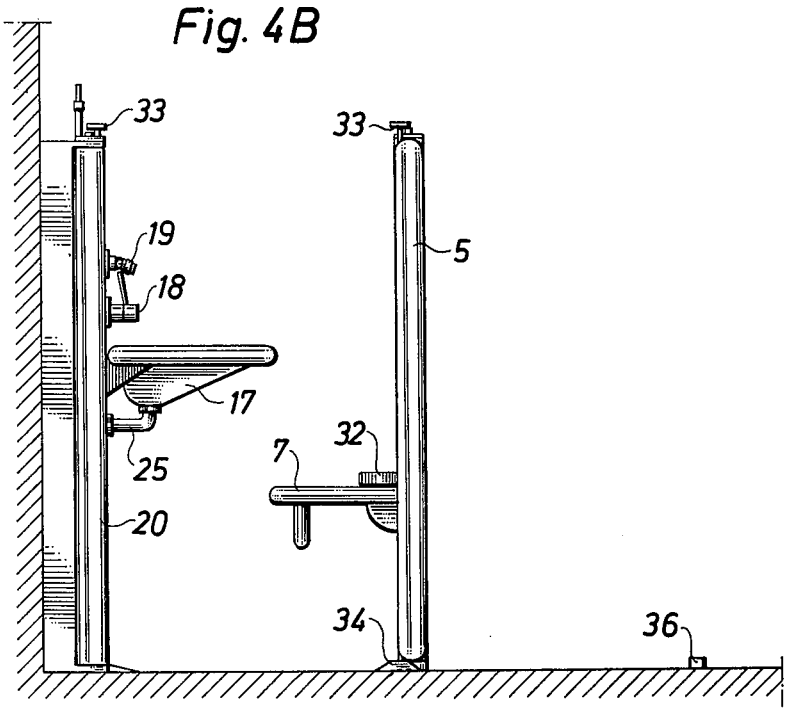

FIG. 4B corresponds to FIG. 4A, the difference being that the wall carrying the seat is in its closed position.

Figures 5, 5A:
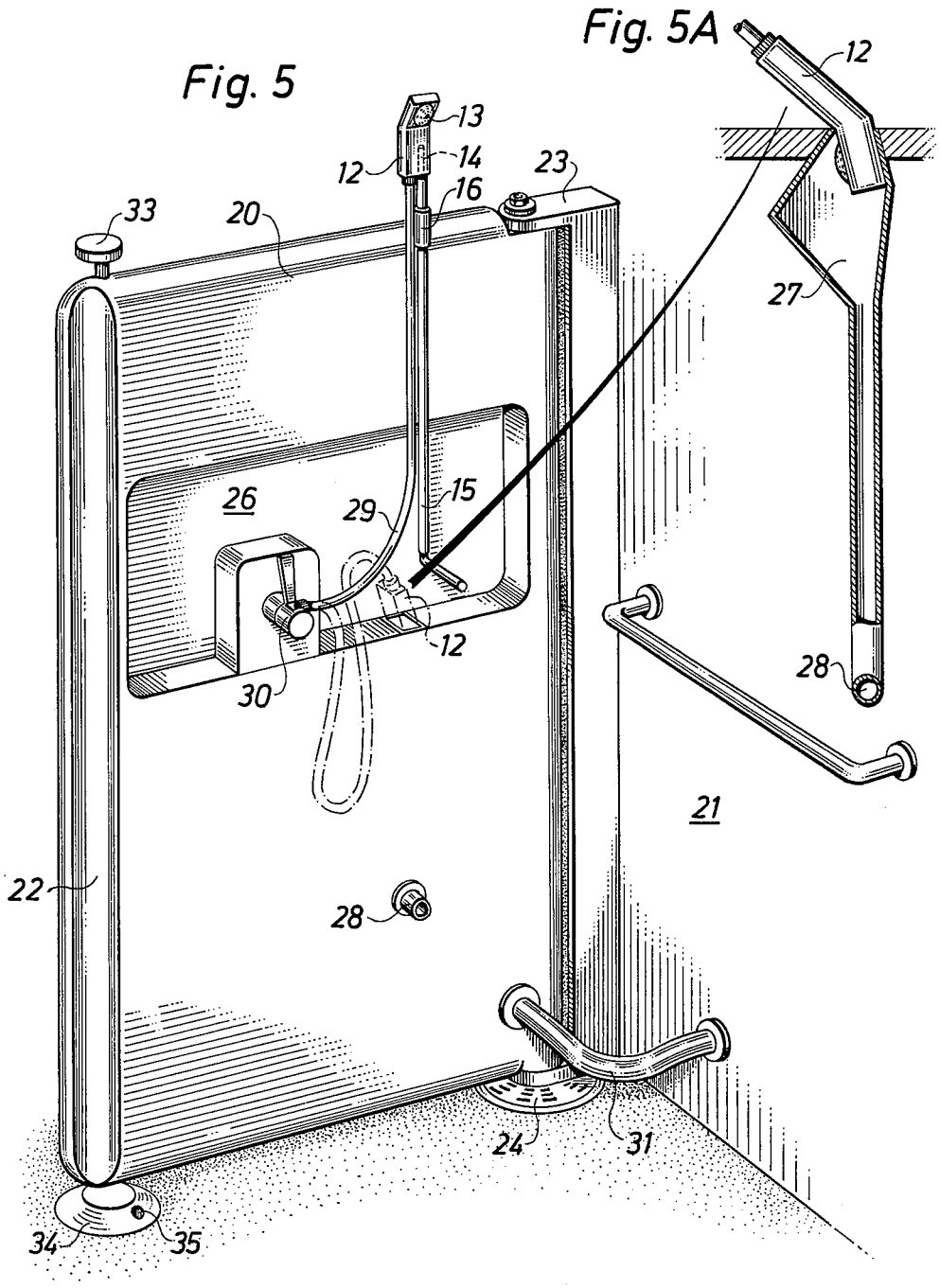

FIG. 5 is a perspective view showing the interior side of the second swingable wall.

FIG. 5A does, on a larger scale and in vertical section, illustrate how the hand shower nozzle can be mounted in the swingable wall.

Figure 6:
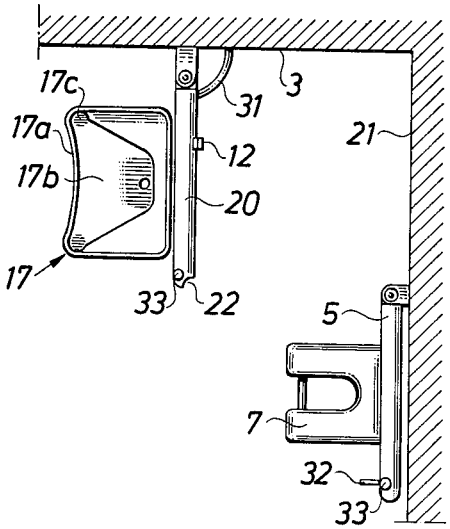

FIG. 6 is a diagrammatic top view of the restroom showing the wall carrying the seat in its open position and the wall having the wash basin in its closed position.

Figure 7:
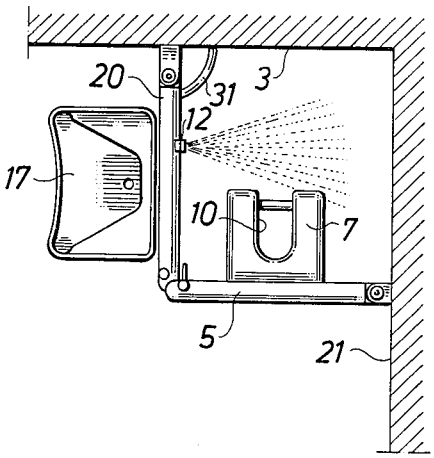

FIG. 7 differs from FIG. 6 in that both of the swingable walls are in their closed positions defining, together with the fixed walls, an omnilaterally closed shower room.

Figure 8:
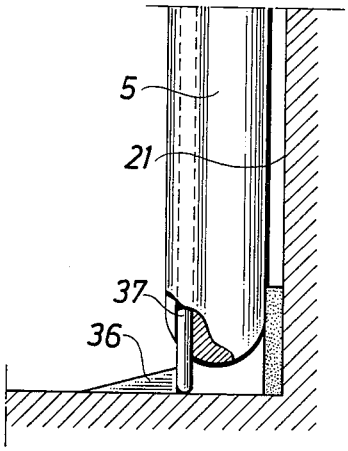

FIG. 8 shows on a larger scale a device for automatically blocking the swingable walls in their end positions.

Figure 1:
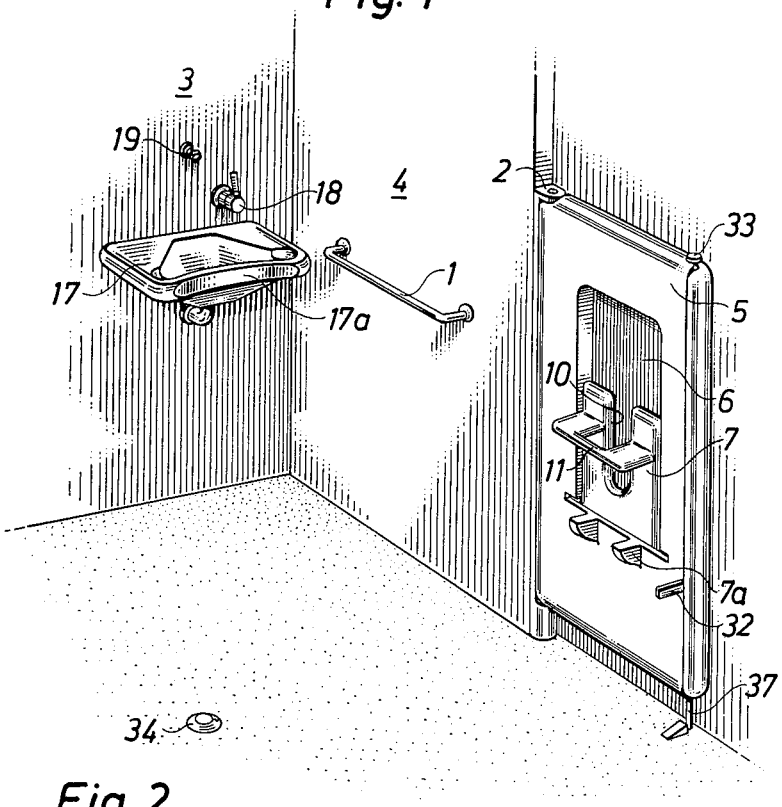
FIG. 1 is a perspective view showing a restroom according to the first embodiment. The room has a swingable wall, shown in its one end position and provided with a foldable seat.

The restroom shown in FIG. 1 is defined by two fixed walls 3, 4 and one wall 5 which is swingable around a hinge 2. Wall 5 has a niche, or recess, 6 of substantially rectangular shape. The lower half of that space receives the bidet seat 7 when the latter is folded to its upright positions as shown in FIG. 1. According to the embodiment here chosen seat 7 is constituted by a substantially square plate which at its lower edge has a pair of pivots 8—see FIGS. 2 and 3. Those pivots are received in a horizontal groove 9 in wall 5. The cross-section of groove 9 is as shown in FIG. 3, i.e. its vertical dimension is essentially greater than the diameter of pivots 8. As also appears from FIG. 3, this means that when seat 7 is folded upwards, its lower edge will settle against the bottom of the groove so that the seat cannot be swung downwards without first being lifted. The practical significance of this arrangement will be explained below. When in its horizontal position, seat 7 rests against a pair of shoulders *7a*. On the fixed wall 4 there is a horizontal handle 1.

A large portion of the central part of the substantially square plate 7 has been removed thus creating an opening 10 which, in the horizontal position of the seat—see FIG. 7—extends from the front edge of the sheet along about ¾ of the dimension of the seat perpendicularly to wall 5. The width of opening 10 approximately equals the width of the remaining seat portion at both sides thereof.

As appears from FIG. 1, seat 7 carries a member 11 substantially shaped like a U having wide shanks and a intermediate web portion of circular cross-section. Member 11 forms a shelf-like support which may deload the legs of a person standing with his back facing wall 5. The corresponding function is illustrated in FIG. 2 in our co-pending application Ser. No. 945,714 to which reference is made. This supporting function is of great importance to many disabled persons, especially since the smooth, glossy walls of a conventional restroom is one of the factors making such rooms useless to heavily disabled persons. However, member 11 has two further functions. It may serve as a handle for a standing person or for a person who has fallen on the floor of the restroom and needs something to grip in order to rise again. As is understood, the above discussed protection against unintentional folding down of the seat is then of great importance.

DESCRIPTION OF TWO PREFERRED EMBODIMENTS

For the purpose of illustrating the operation and the main advantages of the new restroom, let it be assumed that a disabled person sitting in a wheel-chair is to visit the restroom. His first action is to open wall 5 to approximately the position shown in FIG. 1. He then folds down seat 7 to its horizontal position. The space available for wheel-chair allows him to place it in such a position that he can easily move over to seat 7. He then swings wall 5 inwards, relying on handle 1 or on any other suitable means to absorb the corresponding reactional force. When wall 5 has been swung through 90°, he will find himself in a convenient position opposite the wash basin 17. Mounted on the fixed wall 3 above the wash basin is also a mixing valve 18 and a water outlet nozzle 19. In this position he can conveniently wash his face, arms and the upper portion of his body. The front edge of the basin should preferably have a concave front wall 17*a* as illustrated in FIG. 1 and, more clearly, in FIG. 6. It should be noted here that the front wall of a conventional wash basin is usually convex, a shape selected for estethical reasons and most unsuitable to a person having to wash himself in a sitting position. In order further to facilitate the washing and prevent water from flowing down along the arms of the person, the bowl of the wash basin may, at each of its front corners, have semi-circular recesses 17*c* receiving the elbows of the person.

Reference is now made to FIGS. 4–7 illustrating the second preferred embodiment. In this case the restroom has two instead of one swingable walls. The second swingable wall 20 has a first end position in which it is parallel with the fixed wall 3 and a second end position in which it is perpendicular to wall 3. It supports a wash basin 17 which in the first-mentioned position of wall 20, shown in FIGS. 4A and 4B, is in relation to the other fixed wall located as in FIG. 1.

The opposite side of wall 20 is provided with a hand shower equipment, illustrated in FIG. 5. It consists of a handle 12 having a nozzle 13 and a bore 14 which can receive the upper end of a rod 15 journalled in a sleeve 16 secured to wall 20. The bottom end of rod 15 is bent so as to form a handle permitting rotation of rod 15 around its vertical axis. It should be understood that when handle 12 is mounted as shown in FIG. 5, the equipment forms a conventional shower. When released from rod 15, handle 12 serves as a hand shower the water being supplied through a hose 29 the opposite end of which is connected to a mixing valve 30.

Use of two swingable walls offers four different combinations.

The first combination is that illustrated in FIG. 4A. In this position the available free floor area has its maximum value and the wash basin can be used in a conventional manner.

In the second combination, illustrated in FIG. 4B, wall 5 is in its swung-out or closed position, whereas wall 20 occupies the same position as in FIG. 4A. A disabled person can accordingly sit in front of the wash basin after having moved into that position in much the same manner as was above described with reference to FIG. 1. It should be emphasized, and FIG. 4B is intended to illustrate this point, that the wash basin is not accessible to a person sitting in a wheel-chair. This is so for several reasons, the major one being that the foot rest and the front wheels prevent its user from coming sufficiently close to the wash basin.

The third combination is illustrated in FIG. 6. Wall 5 is now again in its open position, whereas wall 20 is perpendicular to wall 3. This means that, if desired, the restroom can simultaneously be used by two persons, one of them using the wash basin 17 and the other one the shower compartment behind wall 20.

FIG. 7 illustrates the fourth combination, where both of the swingable walls are in their closed positions. There is accordingly formed an omnilaterally closed space which could be looked upon as a shower cabin offering an additional possibility of use, the bidet function. Thanks to the shape of seat 7, the presence of opening 10 and the absence of a bidet bowl and any other components below the seat it is possible to introduce the hand shower unit 12 below the seat for washing the abdomen. Naturally, also in this case wash basin 17 may simultaneously be used by another person.

When both of walls 5 and 20 are in their closed positions as shown in FIG. 7, the corner in which they contact each other should be at least substantially water-proof. FIG. 5 illustrates one way of accomplishing this. Along its free vertical edges wall 20 has a longitudinal groove 22 the cros-section of which matches that of the front edge of wall 5. By way of example, that cross-section could be semi-circular. FIG. 5 does also illustrate the mounting of wall 20. The fixed wall 21 supports a heavy bracket 23 provided with a hinge for wall 20. The hinge shaft is suitably constituted by a tube concealed inside wall 20 and opening into the centre of a floor well 24, thereby serving as a sewer pipe to which the outlet tube 25 of the wash basin is connected.

FIG. 5 also illustrates the presence of a recess 26 in wall 20. As shown in FIG. 5A, there is in the bottom wall of recess 26 an opening communicating with a space 27 which may receive the hand nozzle 12 thus making it unnecessary for the disabled person to mount the nozzle at the top of wall 20. Space 27 communicates with a drainage pipe having an outlet orifice 28. Reference numeral 31 designates a hose enclosing flexible hot and cold water tubes.

Walls 5 and 20 can be locked in and released from their end positions by the use of handles 32 mounted at such a low level so as to be conveniently reachable by a sitting person. This has been shown in FIGS. 1 and 4A. Adjacent to their free vertical edges each of walls 5 and 20 has a locking rod 37 journalled for vertical movement inside the wall and controllable by means of handle 32. There is also a corresponding handle 33 at the top of each of those rods. The bottom ends of rods 37 are, in the closed positions of walls 5 and 20, received in holes 35 in a mounting plate 34 on the floor of the restroom. Plate 34 is frusto-conical so that, when the wall is swung towards its open end position, the foot of its rod 37 will by a snapping action enter hole 35. Fixation of the walls in their open positions can be achieved by means of wedges 36 cooperating with rods 37—see FIGS. 4A and 8.

It is to be understood that much of the disclosure of the above specification and of the drawing serves the sole purpose of exemplifying the mode of working the invention which the inventors considered the best one upon having made their invention. It should be equally obvious that the inventive idea is not restricted to the use of any special components or dimensions. Instead, it is based on the realization that use of at least one swingable wall and one foldable bidet seat provides a solution to the problems discussed in the introduction of the specification.

What is claimed is:

1. A restroom for disabled persons comprising:

(a) a first wall;

(b) a sanitary fixture (17);

(c) a seat carried by said first wall;

(d) a hand shower nozzle;

(e) said first wall comprising means for selectively positioning said seat in an upper vertical and a lower horizontal position;

(f) said seat further comprising a central opening (10) to form a bidet in said lower horizontal position allowing the introduction of said hand shower into the space below said opening;

(g) said seat further comprising a cross-member (11) projecting into said room when said seat is in said upper vertical position;

(h) said cross-member having a support surface adapted to support a semi-sitting person; and (i) said first wall having means attached thereto for swinging said first wall about a vertical axis between a first position permiting a disabled person to sit on or rise from said seat, and a second position whereat said seat is opposite said sanitary fixture.

2. A restroom for disabled persons comprising:

(a) first and second swingable walls;

(b) first and second fixed walls;

(c) a seat carried by said first swingable wall;

(d) a hand shower nozzle;

(e) said first swingable wall comprising means for selectively positioning said seat in an upper vertical and a lower horizontal position;

(f) said seat further comprising a central opening (10) to form a bidet in said lower horizontal position allowing the introduction of said hand shower into the space below said opening;

(g) said seat further comprising a cross-member (11) projecting into said room when said seat is in said upper vertical position;

(h) said cross-member having a support surface adapted to support a semi-sitting person;

(i) said first and second swingable walls having means attaching said first and second swingable walls to said first and second fixed walls, respectively, for swinging said first wall about a vertical axis between a first position permiting a disabled person to sit on, or rise from, said seat, and a second position whereat means (34) are provided for placing said first and second swingable walls together, said first and second swingable and fixed walls thereby forming an omnilaterally closed shower cabin.

3. A restroom as claimed in claim 2, wherein said second swingable wall supports sanitary fixtures of the restroom, except said bidet seat.

4. A restroom as claimed in claim 3, wherein said second swingable wall on its one side supports a fixture comprising a wash basin and on its opposite side a fixture comprising said hand shower.

* * * * *